US005280217A

United States Patent [19]

Lapatovich et al.

[11] Patent Number: 5,280,217

[45] Date of Patent: Jan. 18, 1994

[54] APPARATUS FOR COUPLING ENERGY TO ELECTRODELESS LAMP APPLICATORS

[75] Inventors: Walter P. Lapatovich, Marlborough; Scott J. Butler, No. Oxford, both of Mass.

[73] Assignee: GTE Products Corporation, Danvers, Mass.

[21] Appl. No.: 930,127

[22] Filed: Aug. 14, 1992

[51] Int. Cl.[5] ..... H05B 41/16

[52] U.S. Cl. ..... 315/39; 315/248; 313/234

[58] Field of Search ..... 315/39, 246, 248; 313/234

[56] References Cited

U.S. PATENT DOCUMENTS 2,139,815 12/1938 Fodor ..... 315/246
4,041,352 8/1977 McNeill et al. ..... 315/248
4,266,162 5/1981 McNeill et al. ..... 315/39
5,070,277 12/1991 Lapatovich ..... 315/248
5,130,612 7/1992 Lapatovich et al. ..... 315/248

*Primary Examiner*—Robert J. Pascal
*Assistant Examiner*—Michael B. Shingleton
*Attorney, Agent, or Firm*—Victor Lohmann, III; Carlo S. Bessone

[57] ABSTRACT

An improved apparatus for delivering energy to two field applicators includes a power divider electrically coupled to a planar transmission line connecting the two field applicators. The power divider receives an input microwave signal and delivers a first power signal to an applicator along a first leg of the line, and delivers a second power signal to the other applicator along a second leg of the line. The power divider is coupled to the transmission line at a point which is remote from the applicators such that the power signals will encounter substantially identical discontinuities as the signals are coupled into their respective applicators.

13 Claims, 2 Drawing Sheets

APPARATUS FOR COUPLING ENERGY TO ELECTRODELESS LAMP APPLICATORS

FIELD OF THE INVENTION

The present invention relates to electrodeless lamp fixtures and, more particularly, to an assembly for coupling energy to an electrodeless lamp.

BACKGROUND OF THE INVENTION

In conventional electrodeless lamp assemblies, energy is projected into the lamp structure from two field shaping devices, or applicators, which are oriented to face one another so as to define a gap therebetween that accommodates the lamp. The applicators establish a sufficient electromagnetic field in the vicinity of the lamp to initiate and sustain a discharge in the lamp. The applicators are each attached to phased feed points corresponding to respective ends of a planar transmission line.

Current efforts for improving upon the aforementioned lamp assemblies have sought to develop field applicators for optimally and efficiently coupling energy into the lamps. A lamp assembly illustrative of the prior art is disclosed in U.S. Pat. No. 5,070,277, herein incorporated by reference. This assembly uses slow wave applicators made from helical coils which compress the electromagnetic wavelength inside the helix. Further examples of applicator structures for projecting energy into the lamp are found in U.S. Pat. No. 4,041,352 (single-ended excitation), U.S. Pat. No. 4,266,162 (double-ended excitation), and U.S. Pat. No. 5,130,612 (loop applicator).

In each of the above prior art assemblies, the applicators are electrically coupled to one another by planar transmission lines characterized by bends and other discontinuities which affect the propagation of the signal. In particular, the discontinuities are non-identical at the two phased feed points where energy is coupled by the applicators into the lamp structure. Consequently, prior art lamp assemblies exhibit an imbalance in power fed into the applicators, and therefore an imbalance of power deposited into the lamp. Disadvantageously, this power imbalance may affect lamp performance and the temperature distribution inside the lamp.

OBJECTS OF THE INVENTION

It is an object of the present invention to obviate the above-noted and other disadvantages of the prior art.

It is a further object of the present invention to provide improved power division and distribution in planar transmission lines.

It is a further object of the present invention to provide balanced power application to an electrodeless lamp.

It is a yet further object of the present invention to provide a planar transmission line which facilitates tuning to the lamp impedance.

SUMMARY OF THE INVENTION

The present invention relates to an apparatus for coupling energy to first and second field applicators, wherein said applicators are coaxially oriented to define a gap therebetween which accommodates a light source. The apparatus comprises power divider means responsive to an input signal for generating a first and second power signal representative of said input signal, a first transmission medium connected to said power divider means for coupling said first power signal to the first applicator, and a second transmission medium connected to said power divider means for coupling said second power signal to the second applicator.

DETAILED DESCRIPTION OF THE PREFERRED EMBODIMENTS

Figure 1:
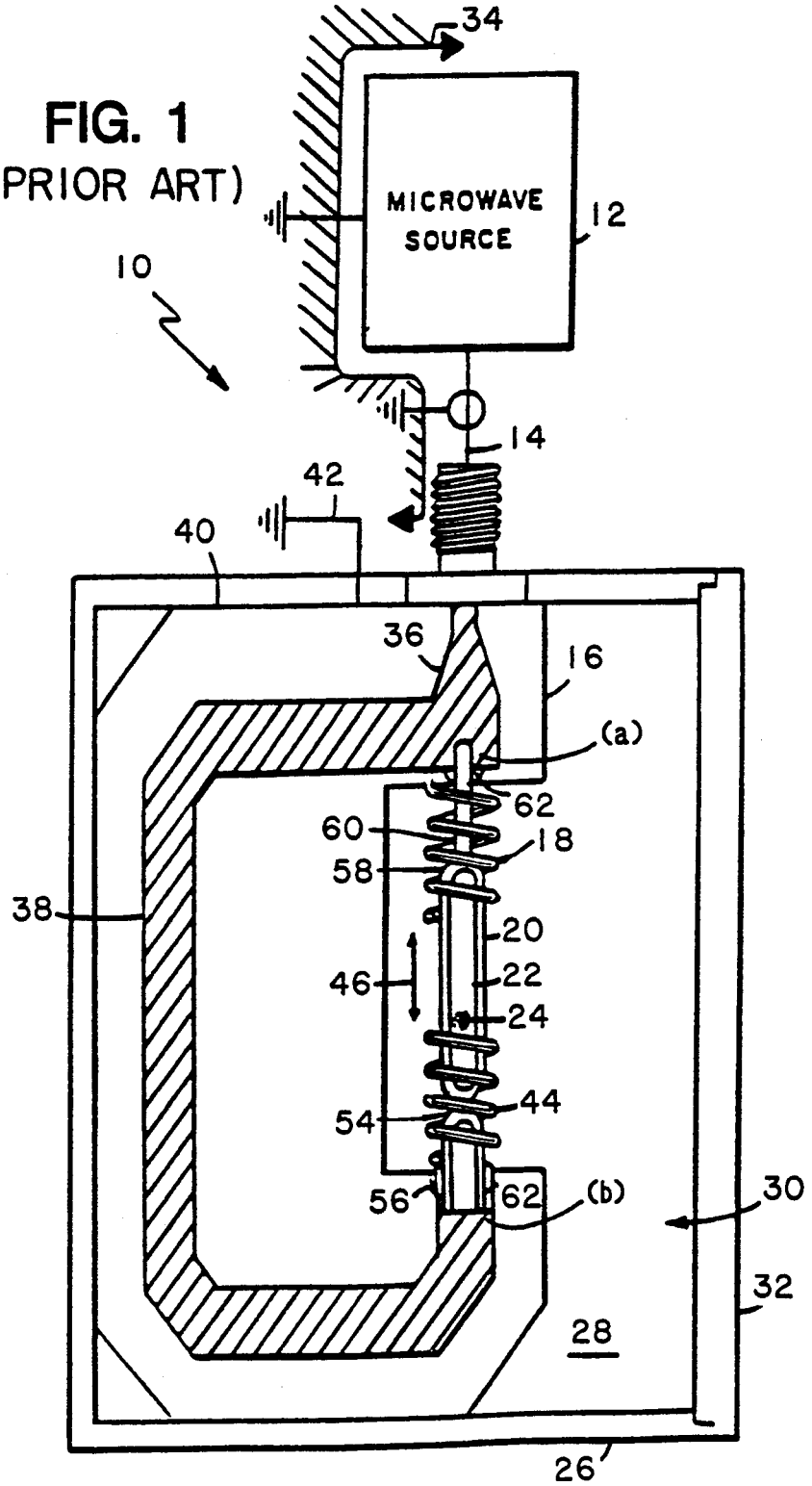
FIG. 1 (PRIOR ART)
FIG. 1 is a lamp assembly illustrative of the prior art.

FIG. 1 shows a prior art lamp assembly disclosed in U.S. Pat. No. 5,070,277, introduced hereinabove. Energy is coupled into capsule 20 by two field applicators 18, 44 separated by a gap 46 which accommodates the lamp. The applicators are positioned coaxially to direct power towards one another, and are preferably helical slow wave couplers.

A power source 12 delivers microwave energy to a coaxial stripline launcher which couples the energy to applicators 18, 44 located at respective ends of the capsule 20. In particular, the stripline launcher couples power from source 12 to field applicator 18 through a stripline conductive strip 36, and couples power to field applicator 44 through 11 microstripline extension 38. The microstripline 36 and extension 38 constitute a planar transmission line, and control the phase relationship between the signals applied to field applicators 18, 44 at points (a) and (b), respectively.

A discontinuity exists in a transmission line when there is an unmatched transition between propagating media. In the assembly of FIG. 1, for example, a discontinuity would exist at the transition from the planar transmission line to the lamp capsule 20. For purposes of comparison, a discontinuity may be characterized quantitatively by its reflection coefficient.

A disadvantage of the transmission line structure in FIG. 1 is that the discontinuities encountered by the signal being coupled to applicator 18 are not identical to the discontinuities encountered by the signal being coupled to applicator 44. In particular, the quasi-TEM wave propagating down the microstripline 36 encounters a discontinuity where the planar line bends at point (a) to form a right-angled bend, at which point power is partially coupled to the first field applicator 18 and partially continues to flow past point (a) to point (b). However, the wave propagating down the microstripline extension 38 encounters a different discontinuity where the extension ends at point (b) in an open transmission line. A measure of the differences in the discontinuities would be reflected in a comparison of the coefficients of reflection at points (a) and (b).

Figure 2:
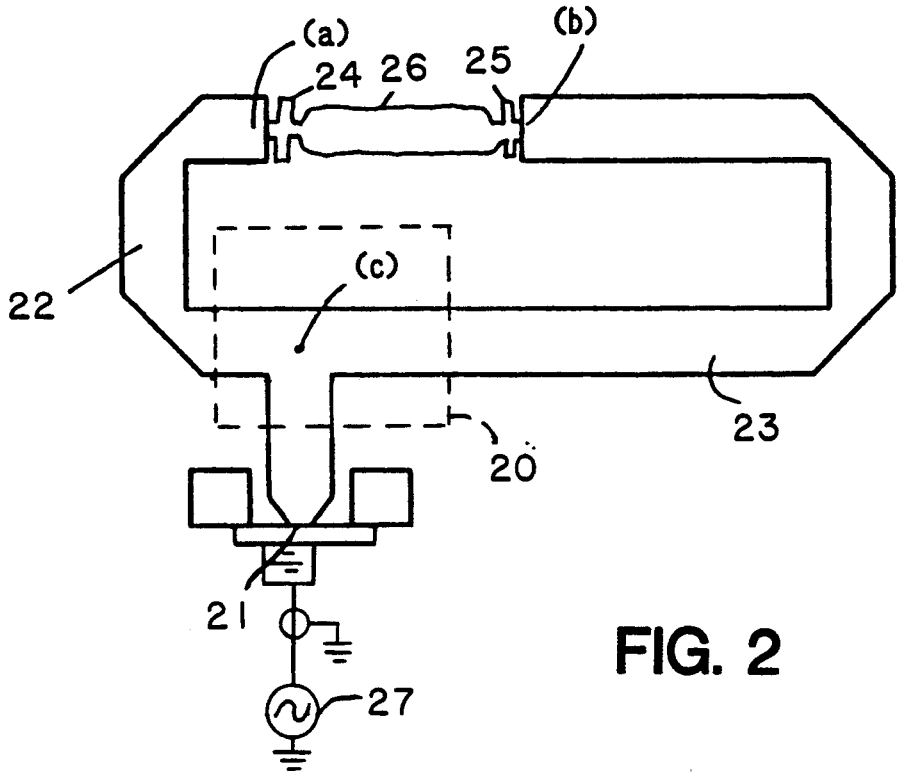
FIG. 2 is a lamp assembly in accordance with a preferred embodiment of the present invention.

The present invention is directed to an improved power distribution system for coupling microwave energy to the applicators. FIG. 2 schematically illustrates one such system in accordance with a preferred embodiment of the present invention.

The power distribution system includes a power divider 20, or symmetric "tee", having an input branch and two output branches coupled to a common junction point (c). The input branch is coupled through an input port 21 to a high frequency power source 27, preferably in the microwave range. The "tee" is in the plane of the substrate or circuit card. For purposes of brevity, the power divider 20 and associated components for supplying energy to the divider will hereinafter be referred to as a power circuit.

The divider 20 has two output ports each coupled from the common junction point (c) to a respective portion of the planar transmission line. Specifically, a first leg 22 of the transmission line couples the first output port of divider 20 to feed point (a), while a second leg 23 of the transmission line couples the second output port of divider 20 to feed point (b). The two power signals from divider 20 propagating along respective legs of the transmission line are coupled into applicators 24 and 25 from feed points (a) and (b), respectively.

As shown in FIG. 2, power is divided at a point (c) remote from the electrical attachment of the field applicators, namely points (a) and (b), while in the prior art assembly of FIG. 1 power is divided at a point (a) adjacent to one of the applicators. The remoteness of this power division is an advantage because the signals propagating along the first and second legs of the transmission line will encounter substantially identical discontinuities as the signals reach their respective feed points in the transmission line and are coupled into the applicators.

In particular, signals of equal power are transmitted down the two legs of the transmission line and fed into discontinuities corresponding to open transmission lines where the field applicators are attached. These discontinuities at the transition from an open line to applicators 24 and 25 are substantially identical, as may be shown by a comparison of the coefficients of reflection at these transitions.

As a further advantage, the remote location of point (c) effectively decouples the power divider from the discontinuities, and thereby facilitates tuning of the power circuit to the lamp impedance. In particular, the impedance transformation from the transmission line to applicators is easily modifiable so as to enable matching of the power circuit impedance (typically 50 Ω) to the effective impedance of the lamp 26 and applicators 24 and 25. Consequently, the present invention provides a more balanced power feed to the lamp than in the prior art.

The first leg 22 introduces an arbitrary phase delay of $\phi$ into the power signal as it propagates from point (c) to point (a). Preferably, the second leg 23 consists of a half-wavelength balun (electrical length of one-half guide wavelength) plus the length of line necessary to introduce the same arbitrary phase $\phi$ as the first leg. Thus, the signals at points (a) and (b) are 180° out-of-phase such that the voltage magnitude across lamp 26 is maximized since the signals coupled into the lamp are added constructively.

In general, the phase delay of each leg may be chosen to produce desired current/voltage values for the signals appearing at feed points a and b. For example, $\phi$ may be easily adjusted to be an odd multiple of 90° in order to achieve any voltage multiplication or impedance transformation which may occur at the discontinuities due to the particular value of $\phi$. The impedance transformation permits substantially balanced power inputs to the feedpoints (a) and (b) of the applicators.

In accordance with a preferred embodiment of the present invention, an assembly based on FIG. 2 was constructed for energizing an electrodeless lamp light source having an NaSc iodide fill with Hg, and an Argon buffer gas. The field applicators were helical structures made of pure nickel wire. The assembly included a PTFE/glass substrate having a thickness dimension of 0.060" with Ni plated Cu microstrip. Although the preferable countour of the transmission line sections included mitered corners as illustrated in FIG. 2, the present invention may be implemented with any type of contour, including curved corners. Finally, the assembly was operable at 915 MHz, and the preferable phase delay was 90°.

As should be readily apparent to those skilled in the art, the assembly of the present invention can support a wide range of operating frequencies, light sources, and transmission lines. For example, the present invention is operable at 2.45 GHz, 915 MHz, and other frequencies, although it is preferable to operate within the allowed ISM bands. The transmission media may be implemented with microstrip, stripline, slotline, slabline, coaxial, hollow waveguide, or twinline; and the transmission media may be metallic, plated, metallic alloy, or high temperature superconducting ceramics such as Y-Ba-Cu-O. Finally, any type of field applicator can be used, including helices, end cups, and loops.

While there has been shown and described what are at present considered the preferred embodiments of the invention, it will be obvious to those skilled in the art that various changes and modifications can be made therein without departing from the scope of the invention as defined by the appended Claims.

What is claimed is:

1. An apparatus for coupling energy to first and second field applicators, said applicators being oriented to define a gap therebetween which accommodates a light source, comprising:

power divider means responsive to an input signal for generating a first and second power signal representative of said input signal;

a first transmission medium connected to said power divider means for coupling said first power signal to the first applicator, said first transmission medium introduces an arbitrary phase $\phi$ into said first power signal; and a second transmission medium connected to said power divider means for coupling said second power signal to the second applicator, said second transmission medium introduces a phase equal to $(\lambda_g/2+\phi)$ into said second power signal, wherein $\lambda_g$ is a propagating wavelength of said second transmission medium.

2. The apparatus as recited in claim 1 wherein:

an operating frequency of said apparatus includes 915 MHz, 2.45 GHz, and frequencies within an ISM band.

3. The apparatus as recited in claim 1 wherein:

said arbitrary phase $\phi$ equals an odd multiple of 90° for said first transmission medium.

4. The apparatus as recited in claim 1 wherein:

said first and second field applicators include helical, end cup, or loop structures.

5. The apparatus as recited in claim 1 wherein:

said first and second transmission media include microstrip, stripline, slotline, slabline, coaxial, hollow waveguide or twinline transmission lines.

6. The apparatus as recited in claim 1 wherein:

said first and second transmission media are fabricated from metallic, plated, metallic alloy, or superconducting ceramic materials.

7. The apparatus as recited in claim 1 wherein:

a contour of said first transmission medium and of said second transmission medium includes mitered corners.

8. The apparatus as recited in claim 1 wherein:

a contour of said first transmission medium and of said second transmission medium includes curved corners.

9. An apparatus for coupling energy to first and second field applicators including a transmission line which electrically interconnects said field applicators, wherein the improvement comprises:

a power divider means coupled to said transmission line at a point remote from said applicators; and said power divider means being responsive to an input signal for generating a first and second power signal each coupled to first and second legs, respectively, of said transmission line, the first leg of said transmission line introduces an arbitrary phase $\phi$ into said first power signal, and the second leg of said transmission line introduces a phase equal to $(\lambda_g/2+\phi)$ into said second power signal, wherein $\lambda_g$ is a propagating wavelength of said second leg.

10. The apparatus as recited in claim 9 further comprises:

an energy source means coupled to said power divider means for generating said input signal.

11. The apparatus as recited in claim 1 wherein:

said arbitrary phase $\phi$ equals an odd multiple of 90° for said first leg of said transmission line.

12. A circuit for delivering energy to a transmission medium interconnecting a first and second field applicator, comprising:

means coupled to said transmission medium for supplying energy to said first applicator along a first leg of said transmission medium, and for supplying energy to said second applicator along a second leg of said transmission medium;

a microwave power source generating a microwave signal; and a power divider responsive to said microwave signal for generating a first and second power signal coupled to the first and second legs, respectively, of said transmission medium, the first leg of said transmission medium introduces an arbitrary phase $\phi$ into said first power signal, and the second leg of said transmission medium introduces a phase equal to $(\lambda_g/2+\phi)$ into said second power signal, wherein $\lambda_g$ is a propagating wavelength of said second leg.

13. A circuit for coupling energy to first and second field applicators which project energy into a light source positioned coaxially between said applicators, comprising:

a source means for generating an input signal;

signal divider means responsive to said input signal for generating a first and second power signal representative of said input signal; and a propagation media having a first transmission line for transporting the first power signal to said first applicator, and having a second transmission line for transporting the second power signal to said second applicator;

said first transmission line introduces an arbitrary phase $\phi$ into said first power signal, and said second transmission line introduces a phase equal to $(\lambda_g/2+\phi)$ into said second power signal, wherein $\lambda_g$ is a propagating wavelength of said second transmission line.

* * * * *